US009099066B2

(12) United States Patent
Welch

(10) Patent No.: US 9,099,066 B2
(45) Date of Patent: Aug. 4, 2015

(54) MUSICAL INSTRUMENT PICKUP SIGNAL PROCESSOR

(71) Applicant: Stephen Welch, Atlanta, GA (US)

(72) Inventor: Stephen Welch, Atlanta, GA (US)

( * ) Notice: Subject to any disclaimer, the term of this patent is extended or adjusted under 35 U.S.C. 154(b) by 0 days.

(21) Appl. No.: 14/213,711

(22) Filed: Mar. 14, 2014

(65) Prior Publication Data

US 2014/0260906 A1 Sep. 18, 2014

Related U.S. Application Data

(60) Provisional application No. 61/782,273, filed on Mar. 14, 2013.

(51) Int. Cl.
*G10H 1/02* (2006.01)
*G10H 3/18* (2006.01)

(52) U.S. Cl.
CPC ..... *G10H 1/02* (2013.01); *G10H 3/182* (2013.01); *G10H 3/186* (2013.01); *G10H 2220/211* (2013.01); *G10H 2220/525* (2013.01)

(58) Field of Classification Search
IPC ..... G10H 1/02
See application file for complete search history.

(56) References Cited

U.S. PATENT DOCUMENTS

| | | | | |
|---|---|---|---|---|
| 5,536,902 | A * | 7/1996 | Serra et al. | 84/623 |
| 5,621,182 | A * | 4/1997 | Matsumoto | 84/610 |
| 5,748,513 | A * | 5/1998 | Van Duyne | 708/320 |
| 5,911,170 | A * | 6/1999 | Ding | 84/661 |
| 6,239,348 | B1 * | 5/2001 | Metcalf | 84/723 |
| 6,664,460 | B1 * | 12/2003 | Pennock et al. | 84/662 |
| 2003/0015084 | A1 * | 1/2003 | Bengtson | 84/622 |
| 2005/0257671 | A1 * | 11/2005 | Aimi | 84/735 |
| 2006/0147050 | A1 * | 7/2006 | Geisler | 381/61 |
| 2006/0206221 | A1 * | 9/2006 | Metcalf | 700/94 |
| 2007/0160216 | A1 * | 7/2007 | Nicol et al. | 381/17 |
| 2008/0034946 | A1 * | 2/2008 | Aimi | 84/604 |
| 2011/0192273 | A1 * | 8/2011 | Findley et al. | 84/743 |
| 2012/0067196 | A1 * | 3/2012 | Rao et al. | 84/611 |
| 2012/0174737 | A1 * | 7/2012 | Risan | 84/622 |
| 2014/0180683 | A1 * | 6/2014 | Lupini et al. | 704/208 |
| 2014/0260906 | A1 * | 9/2014 | Welch | 84/603 |

* cited by examiner

*Primary Examiner* — David Warren

(57) ABSTRACT

A system and method is disclosed that facilitates the processing of a sound signal. In embodiments, an input sound signal can be processed according to a computational model using predetermined parameters. A sound signal originating from a musical instrument can be processed according to coefficients that are generated using a learning model.

20 Claims, 7 Drawing Sheets

MUSICAL INSTRUMENT PICKUP SIGNAL PROCESSOR

CROSS REFERENCE TO RELATED APPLICATION

This application is a non-provisional application claiming the benefit of U.S. Provisional Application Ser. No. 61/782,273, entitled "Improved Pickup for Acoustic Musical Instruments," which was filed on Mar. 14, 2013, and is incorporated herein by reference in its entirety.

TECHNICAL FIELD

This disclosure relates to processing an input sound signal.

BACKGROUND

Modern technology allows musicians to reach large audiences through recordings and live sound amplification systems. Musicians often use microphones for live performance or recording. Microphones can offer good sound quality but may be prohibitively expensive and may be prone to acoustic feedback. Further, microphones are sensitive to variations in distance between the source and the microphone, which may limit the mobility of the performers on stage. Acoustic pickups give acoustic musicians an alternative to microphones. Pickups may consist of one or more transducers, attached directly to the instrument, which convert mechanical vibrations into electrical signals. These signals may be sent to an amplification system through wires or wirelessly. Acoustic pickups may be less prone to feedback, but may not faithfully re-create the sounds of the instrument. One type of acoustic pickups make use of piezoelectric materials to convert mechanical vibrations into electrical current. Often mounted under the instrument bridge of an acoustic instrument, piezoelectric pickups have been cited as sounding "thin", "tinny", "sharp", and "metallic". Other pickup designs have made use of electromagnetic induction and optical transduction techniques. Acoustic instruments with pickups installed, especially acoustic guitars, are sometimes referred to as "acoustic-electric".

Sound reinforcement for acoustic instruments may be complicated by audio or acoustic feedback. Feedback occurs when sound from an amplification system is picked up by a microphone or instrument pickup and re-amplified. When feedback is especially severe, feedback loops can occur wherein a "howling" or "screeching" sound occurs as a sound is amplified over and over in a continuous loop. Acoustic instruments are, by design, well-tuned resonators, making instrument bodies and strings susceptible to such audio feedback. Acoustic instruments may be forced into sympathetic vibration by amplification systems, changing the instrument's behavior, and complicating live sound amplification solutions.

BRIEF DESCRIPTION OF THE DRAWINGS

Like reference numbers and designations in the various drawings indicate like elements.

DETAILED DESCRIPTION

The several embodiments described herein are provided solely for the purpose of illustration. Embodiments may include any currently or hereafter-known versions of the elements described. Therefore, persons in the art will recognize from this description that other embodiments may practice various modifications and alterations.

In embodiments, given an input signal x[n] to a linear time-invariant system, and output signal y[n], a transfer function H(s), may be determined and used to estimate y[n] given x[n]. First, a frequency domain representation of x and y may be determined using a Z-transform:

$$X(s)=Z\{x[n]\},\ Y(z)=Z\{y[n]\} \tag{1}$$

The transfer function H(s), is then given by:

$$H(s)=\frac{Y(s)}{X(s)}. \tag{2}$$

A discrete time linear filter may then be built to approximate the frequency-domain transfer function H(z) by fitting parameter vectors a and b:

$$H(s)=\frac{B(s)}{A(s)}=\frac{b(1)z^{n}+b(2)z^{n-1}+\ldots+b(n+1)}{a(1)z^{m}+a(2)z^{m-1}+\ldots+a(m+1)} \tag{3}$$

The corresponding discrete time implementation is then:

$$\hat{y}[n]=-\sum_{m-1}^{M}a(m+1)y[M-m]+\sum_{n=0}^{N}b(n+1)x[N-n] \tag{4}$$

Equation (4) may then be used to generate an estimate of y[n], ŷ[n] given x[n].

An example embodiment includes a process for processing one or more pickup signals from an acoustic instrument through the incorporation of an algorithm. The process algorithm can be performed using various mathematical techniques to create a high quality sound from low quality sensor inputs, and can be designed to emulate high-quality microphone signals. The application of the process algorithm is broken into distinct "training" and "implementation" phases. Training phases are described in FIG. 1 and FIG. 3, where the process algorithm is trained, using external microphone signals, to later recreate the microphone signals with no microphones present (implementation phase, described in FIG. 2, FIG. 4, and FIG. 5). The process algorithm training results in a collection of coefficients that are stored in memory to be later used in the implementation phase.

Figure 1:
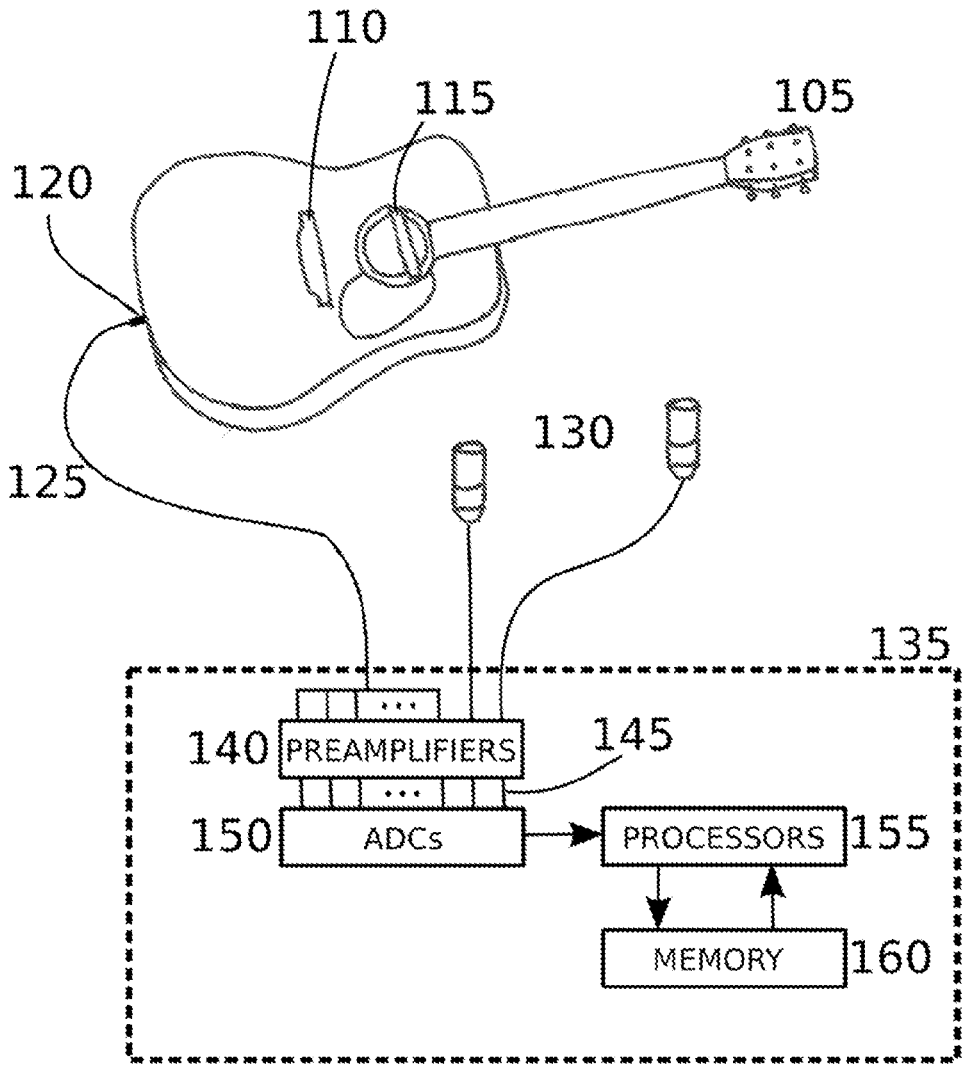
FIG. 1 is a diagram illustrating an example of an operational setup that may be used in training a processing algorithm.

FIG. 1 depicts a system for capturing sound from a musical instrument, for example an acoustic guitar 105, and training a processing algorithm. An acoustic guitar 105 can include a bridge 110, with the instruments' strings acoustically coupled to the body. Guitar 105 may have one or more sensors (not shown) internally installed, for the purpose of converting mechanical vibration or sound into electrical signals. The sensors can include piezoelectric sensors mounted with adhesive or double sided tape beneath bridge 110, or elsewhere inside the instrument. Example piezoelectric sensors include K+K™ Pure Mini™, or other type. Guitar 105 may have magnetic soundhole pickup 115 installed, for the purpose of converting string vibrations into electrical signals. The guitar 105 may also have an internal microphone (not shown) mounted to the back of magnetic pickup 115 or elsewhere in the instrument. An example internal microphone may include an Audio-Technica™ ATD-3350 or other type. Additional sensors can include but are not limited to the following types: piezoelectric, electret, magnetic, optical, internal or external microphone, accelerometer.

The sensors may be connected via individual wires to AV jack 120. The cable 125 may be connected to AV jack 120 and carries each sensor signal along one or more separate wires. One or more microphones 130 may be placed in reasonable proximity of the guitar 105 to record audio signals from guitar 105. Alternatively, the microphones 130 can be positioned by an expert (e.g., recording engineer, or other expert in the field), to optimally capture the sound of the instrument. Optimal positioning may include placing one microphone 6-12" from the $12^{th}$ fret of guitar 105, and a second microphone 12"-18" from the instrument soundboard between audio-video (AV) jack 120 and bridge 110, angled towards the sound hole, or other microphone placements deemed optimal by an expert.

The acoustic environment may be controlled when capturing audio signals. This controlling may be accomplished by working inside a recording studio environment or anechoic chamber. Microphones 130 and cable 125 are connected to processing hardware 135. Example processing hardware 135 can include a digital computer with attached analog to digital converter (ADC) and pre-amplifiers, or dedicated hardware including a pre-amplification stage, ADCs, processing in the form of digital signal processing (DSP) chip and/or field programmable gate array (FPGA), system-on-module (SOM), or microcontroller and memory, or mobile device such as a tablet or smartphone with pre-amplification means, or other hardware capable of pre-amplifying, digitizing, processing multiple signals, and storing results.

The pre-amplifiers 140 may boost individual gain for each sensor and microphone and provide the needed input impedance for each sensor and microphone. Additional, pre-amplifiers 140 may be included to provide any necessary power to microphones or sensors. ADCs 150 convert each microphone and sensor signal into the digital domain. Example ADCs 150 may include Wolfson Microelectronics™ WMB737LGEFL. The ADCs may employ sampling rates that do not create undesirable aliasing effects for audio, for example 44.1 KHz or higher. An example processor 155, may include a central processing unit (CPU) of a digital computer, or a DSP chip and/or microcontroller capable of performing numeric calculations and interfacing with memory. Example memory may include random access memory (RAM), or more permanent types of computer memory. Processor 155 may calculate a variety of algorithm coefficients. A means for moving the contents (not shown) from the memory 160 to other devices may also be included.

Figure 2:
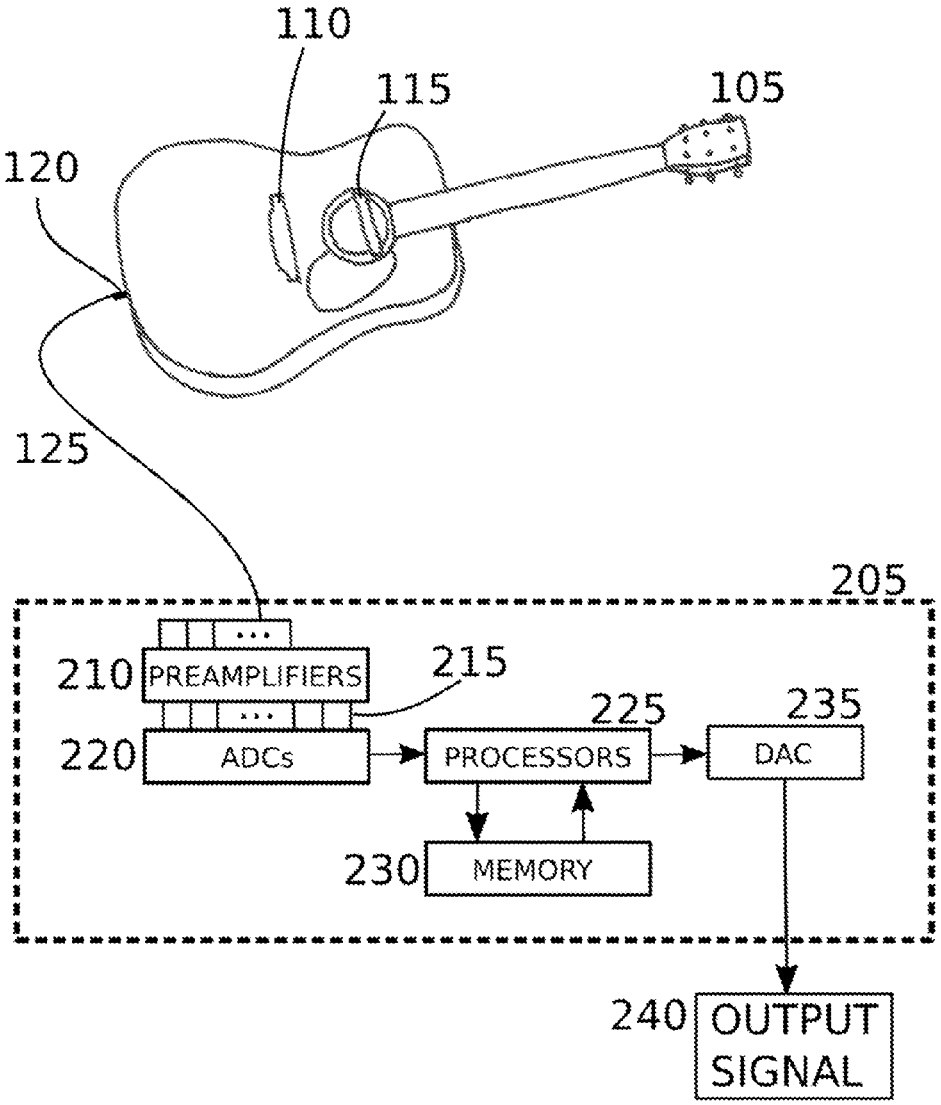
FIG. 2 is a diagram illustrating an example of an operational setup that may be used in processing acoustic instrument pickup signals.

FIG. 2 shows an example implementation phase of the overall approach, in which the algorithm coefficients are used to process sensor signals. A system is shown for capturing sound from the musical instrument through multiple sensors, processing each sensor signal, and outputting a final signal for amplification or recording. Example processing hardware 205 may include one of the processing hardware 135 discussed above. Example pre-amplifiers 210, ADCs 220, processor 225 and memory 230 can include the forms of pre-amplifiers 140, ADCs 150, processor 155 and memory 160, respectively. The example training phase shown in FIG. 1, and the implementation phase described in FIG. 2, may be performed on a single piece o processing hardware. Alternatively, the size and complexity of implementation processing hardware 205 from training processing hardware 135 may be reduced. A digital to analog converter (DAC) 235 may convert the digital output signal into the analog domain. Example DAC 235 may include a Texas Instruments™ PCM2706CPJT. The analog output signal 240 may then be used for recording or amplification.

Figure 3:
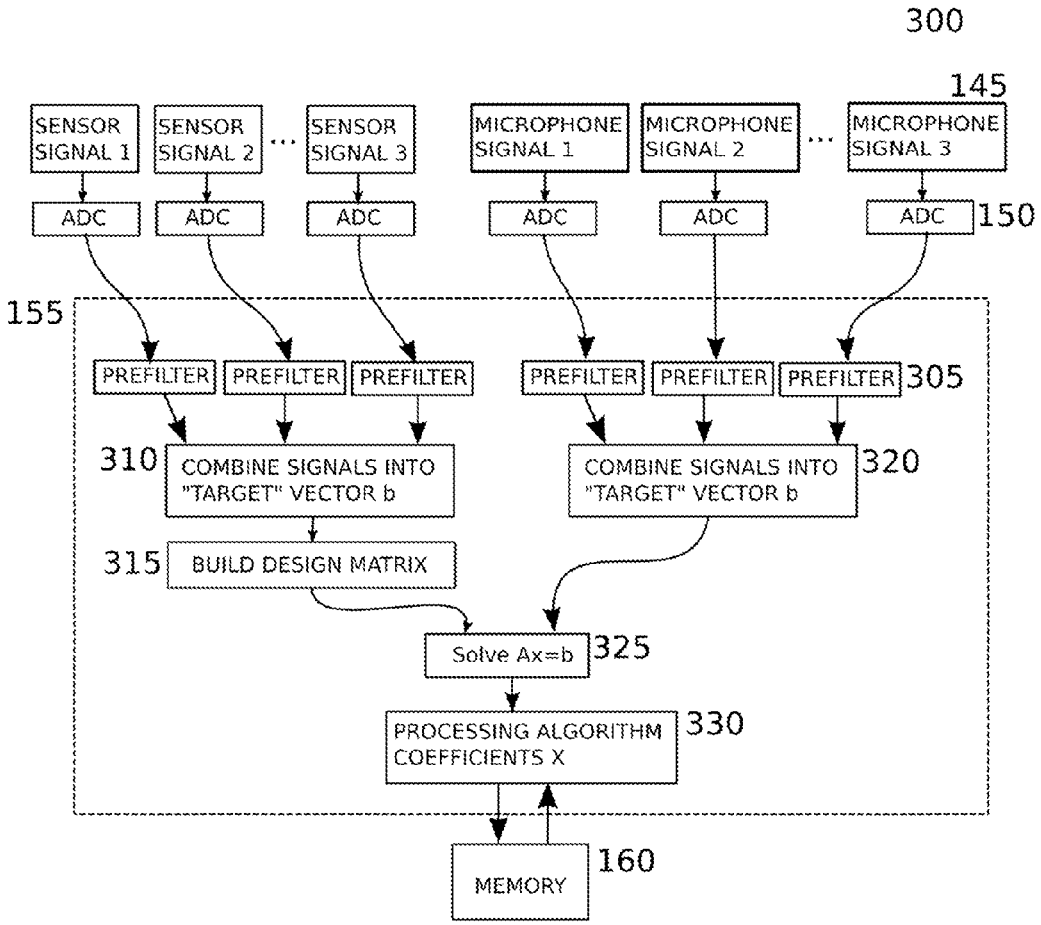
FIG. 3 is a flow chart illustrating an example process for training processing algorithm coefficients.

FIG. 3 describes a signal processing algorithm method 300 for training algorithm coefficients. As described above, sensor and microphone signals from pre-amplifiers 140 are converted into the digital domain in ADCs 150 and then processed in processor 155. Within processor 155, each signal is filtered with a finite-impulse response (FIR), or infinite-impulse response (IIR) filters 305. Example filters 305 can include IIR high-pass filters with cutoff frequencies between 20 and 50 Hz, configured to reject low-frequency noise from the captured signal. The IIR filter coefficients may ensure that each filter's stop band and pass band are below and above, respectively, the desired cutoff frequency.

Coefficients may be automatically determined using filter design tools available, for example, in MATLAB™, Octave, Python, or other software package. The filtered sensor signals may then be interleaved in step 310 for example with equation (5). Given signal vectors:

$$S^1 = \begin{bmatrix} S_n^1 \\ S_{n-1}^1 \\ \vdots \\ S_{n-k}^1 \end{bmatrix}, S^2 = \begin{bmatrix} S_n^2 \\ S_{n-1}^2 \\ \vdots \\ S_{n-k}^2 \end{bmatrix}, S^3 = \begin{bmatrix} S_n^3 \\ S_{n-1}^3 \\ \vdots \\ S_{n-k}^3 \end{bmatrix}, \tag{5}$$

a single interleaved vector is then determined by:

$$S_{Interleaved} = [S_n^1\, S_n^2\, S_n^3\, S_{n-1}^1\, S_{n-2}^2 \ldots S_{n-k}^3]. \tag{6}$$

Signal vectors shown here may be interpreted as digitized voltage values.

A design matrix may be constructed in step 315 from one or more of the interleaved sensor signals from Step 310. In the Step 315 matrix, each interleaved sensor signal may correspond to a single column of the design matrix shown in equation (7).

$$A = \begin{bmatrix} S_n^1 & S_{n-1}^1 & & S_{n-j}^1 \\ S_n^2 & S_{n-1}^2 & & S_{n-j}^2 \\ S_n^3 & S_{n-1}^3 & \cdots & S_{n-j}^3 \\ \vdots & \vdots & & \vdots \\ S_{n-k}^3 & S_{n-k-3}^3 & & S_{n-k-j}^3 \end{bmatrix}, \tag{7}$$

All of the filtered microphone signals may be combined in step 320. The signals may be combined by summing all microphone signals together into "target" vector b as shown in step 230. The filtered microphone signals can include signal vectors $M^1, M^2, \ldots, M^m$, $$b = M^1 + M^2 + \ldots + M^m \tag{8}$$

Alternatively, the signals can be combined using the expert knowledge of a recording engineer as described above, for example through equalization, delay, phase shifting, and carefully selected signal gains. Alternatively, signals may be mixed in specific proportions to achieve a desired tonality.

The signals from design matrix A in step 315 and target vector b in step 320 may be then used in step 325 to solve an overdetermined system by least squares, resulting in $\hat{x}$.

$$\hat{x} = (A^T A)^{-1} A^T b \tag{9}$$

$\hat{x}$ may be the vector of computed algorithm coefficients used in the configuration described in FIG. 2. These coefficients are trained or "learned" from the method described above, and may be interpreted as describing the relationship between sensor and microphone signals.

Algorithm coefficients are shown as x in step 330. In alternative embodiments, design matrix A and target vector b can be used as part of other techniques, for example weighted least squares, nonlinear system identification, training of artificial neural networks, adaptive filtering approaches, deterministic modeling, Gaussian process modeling, non-linear least squares or treed models. Algorithm coefficients may then be stored in memory 160 to be used later by processing hardware 135, or to be transferred to other processing hardware, such as processing hardware 205.

In general, inputs taken from sensor signals, such as design matrix A and outputs taken from microphone signals, such as target vector b, may be used as the inputs and outputs of a learning model. A learning model may be understood as a computational model design to recognize patterns or learn from data. Many learning models are composed of predefined numerical operations and parameters, which may be numerical values that are determined as the learning model is trained on example data. Learning models may be supervised or unsupervised. Supervised models rely on label input and output data. A supervised learning model may be given an input signal and output signal and trained to reproduce the output from the input.

An artificial neural network is an example of a supervised learning approach. Artificial Neural Networks modify their connector strengths (through changing parameters) between neurons to adapt to training data. Neural networks may consist of many layers, this may be referred to as a deep belief or deep neural network. Neural Networks may further make use of circular recurrent connections (wherein the output of a neuron is connected to the input of another neuron earlier in the chain). Training data provided to neural networks may first be normalized by, for example, dividing by the standard deviation and subtracting the mean. Neural networks may be trained by, for example, a backpropagation algorithm that back propagates errors through the network to determine ideal parameters. Backpropagation may rely on the minimization of a cost function. Cost functions may be minimized by a number of optimization techniques, such as batch or stochastic gradient decent. An example cost function may be the mean square error of the output of the model, compared to the correct output, as shown in equation 10.

$$C = \frac{1}{2}\|\text{output} - y\|^2 \tag{10}$$

Where C in equation 10 is the cost associated with a single training example. The overall cost of a specific model may be determined by summing the cost across a set of examples. Further, a regularization term may be added to the overall cost function, that increases the cost function for large model parameters, reducing the potential complexity of the model. Reducing the complexity of the model may decrease the potential for the model to overfit the training data. Overfitting occurs when a model is fit to the noise in a data set, rather than the underlying structure. An overfit model can perform well on the training data, but may not generalize well, meaning the model may not perform well on data that the model was not trained on.

Alternatively, unsupervised learning models may rely on only input data. For example, sensor data alone may be used to learn about the structure of the data itself. Alternatively, professional or commercial recording of acoustic instruments may be used to learn model parameters that represent the structure of the underlying data. Algorithms such as k-means clustering may be used to group similar windows of input data together. Further, it may be useful to cluster a frequency representation of the input data, such as the Fourier transform, rather than the input data itself. It may also improve algorithm performance to first normalize input data by, for example, subtracting the mean and dividing by the standard deviation. Once similar regions in the input data have been identified, separate sub-models may be trained on each region. These sub-models may offer improved performance over a single model applied to all data. The blending of various sub-models may be accomplished by, for example, determining the Euclidean distance between window of input data and the centroid of each cluster earlier determined by k-means. The Euclidean distance may be then used to choose, prefer, or provide more weight to the model that corresponds to the centroid that is closest, or has the shortest distance to the current input data window. Alternatively, a weighted distance metric may be used rather than Euclidean distance.

Figure 4:
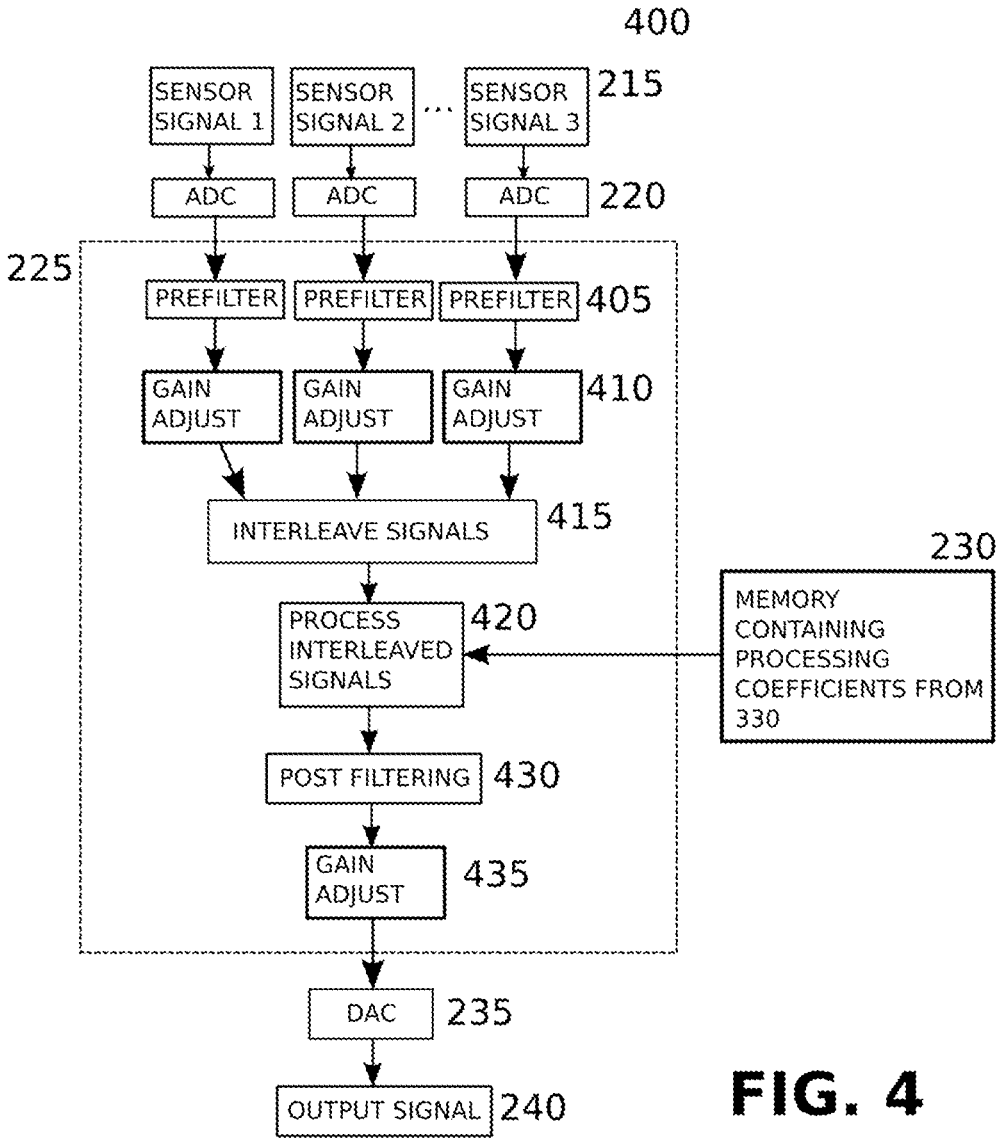
FIG. 4 is a flow chart illustrating an example process for processing acoustic instrument pickup signals.

In FIG. 4, an example processing method 400 is shown and includes capturing signals 215 with the sensors as described in FIG. 1. In step 405 each digital signal may be filtered with a finite impulse response (FIR) or infinite impulse response (IIR) filter, as described above. The filtered signals may be then gain adjusted in step 410. Gain adjusting in the digital domain may include multiplying each sample by a fixed number, and is useful when one sensor signal is louder or quieter than others. Gain shifting may also be achieved by bit shifting. The gain adjusted sensor signals may then be interleaved in step 415 into a single vector representation through the interleaving processes described above.

The interleaved vector may then be processed in step 420 using similar processing hardware and processing methods presented above. The signal may then be post filtered in step 335 with a FIR or IIR digital filter distinct from the pre filters presented above. The post filter may be determined from the transfer function between the processed interleaved signal 415 and an ideal microphone signal, in order to emulate the frequency response recorded by an external microphone.

The post-filtered signal 430 may be gain adjusted in step 435 to ensure the appropriate output amplitude. The gain adjusted signal 435 may be then converted to the analog domain in DAC 235 and output in step 240.

Figure 5:
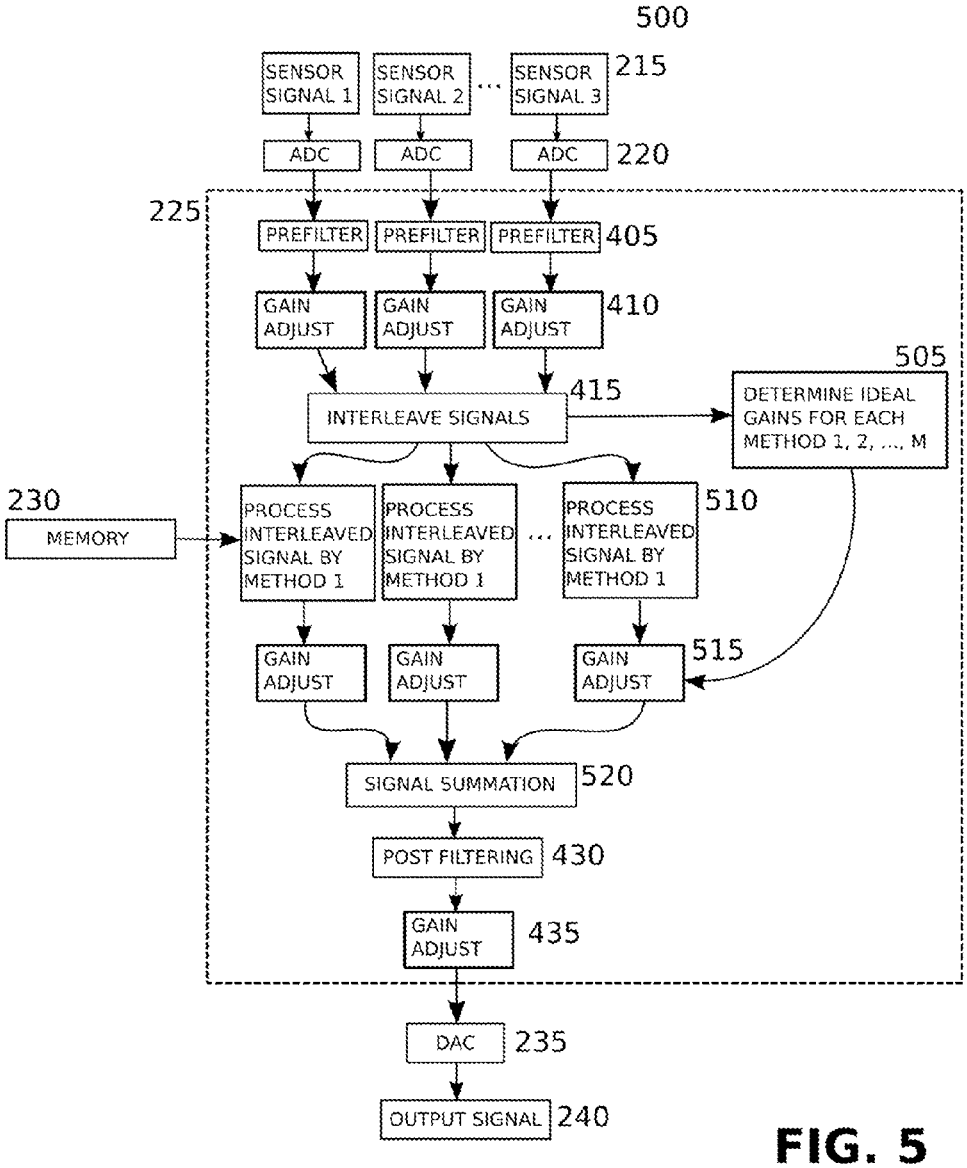
FIG. 5 is a flow chart illustrating an example process for training processing algorithm coefficients for multiple processing algorithms.

FIG. 5 shows an alternative example method 500 for processing the sensor signals from the acoustic guitar 105. As described above, signals may be pre-filtered, gain adjusted, and interleaved in steps 415, 410, and 415, respectively. Method 500 may include more than one processing method to produce more accurate or better-sounding results. The interleaved signal may be used in determining ideal gains 505. Gains 505 may control the amount that each of the methods 510 contribute to the overall output signal. For example, the amplitude of the interleaved signal 415 may be monitored in step 505, and used to select appropriate gains. Some processing methods are more accurate at lower volumes, while others are more accurate at higher volumes. By monitoring the amplitude of signal 415, high gains can be assigned to methods 515 that perform well at the amplitude observed in signal 415. Alternatively, some methods perform better during transients (e.g., the plucking of strings in the case of the guitar). Step 505 can be used to detect transients and select higher gains for models that perform well during transients. Determining ideal gains may also make use of frequency-based techniques (not shown), such as the Fourier Transform. For example, the Fourier Transform of an input signal may be taken and individual frames of Fourier Transform may be used as the inputs to learning algorithm that may, for example differentiate acoustic transients from acoustic sustain periods. Different models or model types may be trained on different portions of the data (e.g. transient portions vs. sustained portions). In implementations, audio portions with Fourier Transforms more similar to predetermined archetypes of attacks versus sustains may trigger higher gains for models that perform better on such types of audio. Similarly between Fourier Transforms of audio data may be determined by metrics such as Euclidean distance. Finally, other metrics may be useful, such as A-weighted Euclidean distance.

The interleaved signal 415 may be fed into a plurality of methods indicated in step 510, for example, method 300. Alternatively, numerous example approaches can be implemented such as: weighted least squares, nonlinear system identification, training of neural networks, adaptive filtering approaches, deterministic modeling, Gaussian Process (GP) modeling, non-linear least squares or treed models. In step 515 the output of each method in step 510 may be gain adjusted according to the output of step 505. The signals produced in step 515 may be summed in step 520. The signal from step 520 may be filtered with a digital FIR or IIR filter 430. The filtered signal 430 may be gain adjusted in step 435 and output as discussed earlier.

In an alternative example embodiment, training is conducted (FIG. 1, FIG. 3) on the same instrument on which the pickup system is installed, effectively using the processing algorithm (i.e., when implemented in method 400, 500 or other embodiment) to re-create the sound that would be captured from a microphone placed in front of that unique instrument.

In an alternative embodiment, training can be conducted on a separate instrument from method 400 or 500 in order to re-create sounds of vintage or otherwise desirable acoustic instruments. By training the processing algorithm on a vintage guitar, the results may be interpreted as "training" the desirable acoustic characteristics of the vintage instrument into the algorithm. This algorithm may then be applied in method 400 or 500 to other instruments, allowing lower quality instruments to take on the characteristics of vintage or higher quality instruments when amplified.

In an alternative embodiment, training may be implemented in conjunction with method 400 or a similar method as means to build a processing algorithm uniquely tailored to a specific player. By applying the training methods shown here or similar method to data collected from a single player, the algorithm may be interpreted as "trained" to the playing style of that musician.

The output signal 240 shown in FIGS. 2, 4 and 5 is intended to be used in live sound amplification or recording applications. In live sound applications, the output signal 240 may provide a high-quality alternative to using microphones, potentially reducing feedback and performer mobility issues, while retaining high-quality sound. In recording applications, the output 240 may be used instead microphones to provide a high-quality signal.

An example embodiment includes a musical instrument equipped with one or more interior or exterior microphones used to capture and reject external sounds, leaving only the sound created by the musical instrument for live sound applications.

Figure 6:
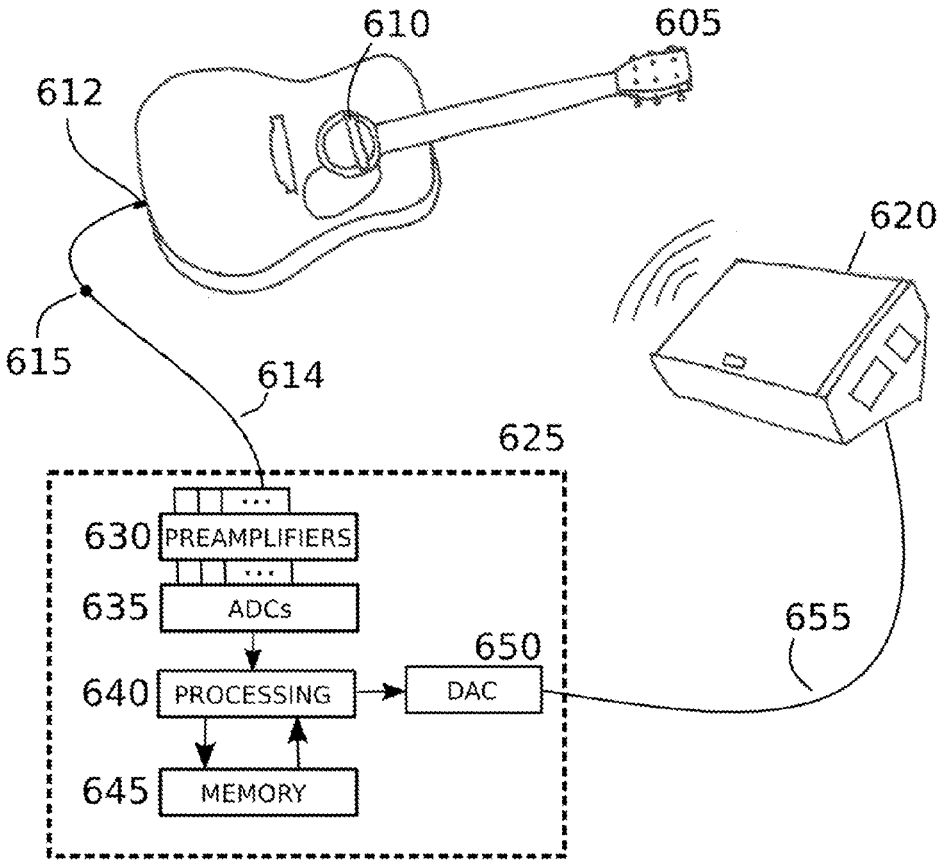
FIG. 6 is a diagram illustrating an example of an operation setup for preventing audio feedback acoustic musical instrument amplification systems.

FIG. 6 depicts a system for reducing noise and feedback picked up by musical instruments, for example, acoustic guitar 605. Guitar 605 may include pickup system 610, which may include a magnetic string pickup mounted in the guitar soundhole, one or more internal microphones (not shown), or other sensor types installed inside or outside the instrument. Example internal microphone can include an Audio-Technica™ ATD-3350. The sensors may be connected via individual wires to AV jack 612. Cable 614 may be connected to AV jack 612 and may carry each sensor signal in separate wires. Microphone 615 may be mounted to cable 614 and is hereafter referred to as "anti-feedback" microphone. Anti-feedback microphone 615 can be placed in alternative locations, such as instrument 605 headstock, on the performer, or elsewhere in the performance space. Multiple anti-feedback microphones can be included. Cable 614 may be connected to processing hardware 625.

Example processing hardware 625 may include a digital computer with attached analog to digital converter (ADC) and pre-amplifiers, or dedicated hardware including a pre-amplification stage, ADCs, processing in the form of digital signal processing (DSP) chip and/or field programmable gate array (FPGA), system-on-module (SOM), or microcontroller and memory, or mobile device such as a tablet or smartphone with pre-amplification means, or other hardware capable of pre-amplifying, digitizing, processing multiple signals, and storing results. Pre-amplifiers 630 may individually boost gain for each sensor and microphone and provide the needed input impedance for each sensor and microphone. Additionally, pre-amplifiers 630 may provide power to microphones or sensors. ADCs 635 may convert each microphone and sensor signal into the digital domain. Example ADCs 635 can include a Wolfson Microelectronics™ WMB737LGEFL, or other type. The ADCs discussed may employ sampling rates that do not create undesirable aliasing effects for audio, for example 44.1 KHz or higher.

Processor 640 may be the central processing unit (CPU) of a digital computer, or a DSP chip and/or microcontroller capable of performing numeric calculations and interfacing with memory. Example memory 645 may be random access memory (RAM), or more permanent types of computer memory. Digital to analog converter (DAC) 650 can convert the digital output signal into the analog domain. An example DAC 650 may be a Texas Instruments™ PCM2706CPJT. The output 655 from the DAC 650 may be sent to amplification system 620. The output of DAC 650 may be processed further, but is ultimately intended to be connected to a monitoring system, or amplification system such as amplification system 620.

Figure 7:
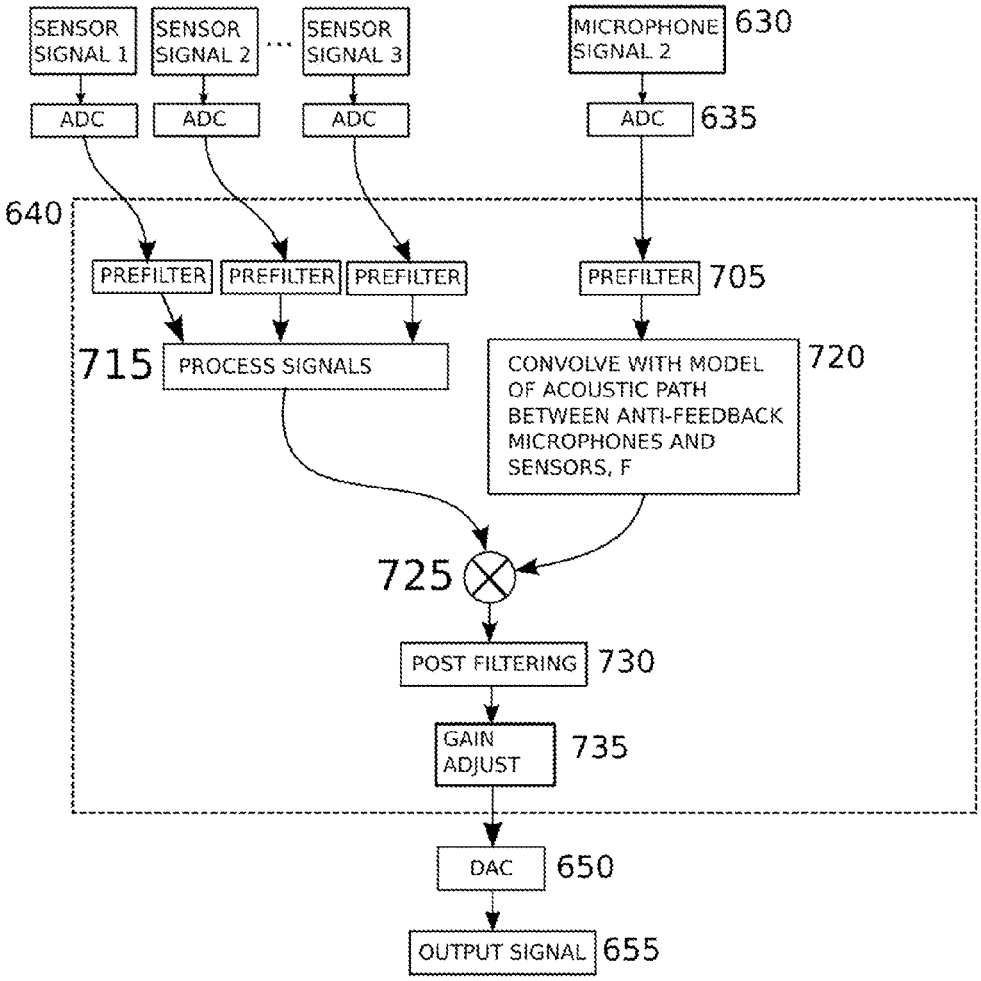
FIG. 7 is a flow chart illustrating an example process for preventing audio feedback in acoustic musical instrument amplification systems.

FIG. 7 shows an example processing method for removing noise and feedback from sensor signals from musical instruments. In step 705 each digital signal may be filtered with a finite impulse response (FIR) or infinite impulse response (IIR) filter, as described above. Filters 705 may be IIR high-pass filters with cutoff frequencies between 20 and 50 Hz, configured to reject low-frequency noise from the captured signal. IIR filter coefficients ensure that each filters' stop band and pass band are below and above, respectively, the desired cutoff frequency. Coefficients may be automatically determined using filter design tools available in MATLAB™, Octave, or other software package.

Sensor signals are processed in step 715, for example, by the process described above. Anti-feedback microphone signals may be convolved with a model of acoustic path between anti-feedback microphones and sensors, F in step 720. Model F may be determined through the following steps.

A musical instrument including a pickup system is connected to an amplification system in a performance space, in one embodiment the system is set up in a performance space in preparation for a later performance.

One or more anti-feedback microphones are placed and connected to a digital computer.

A reference sound, such as a test noise (white noise, pink noise, or others), or a musical recording is played through the amplification system.

Both the anti-feedback microphone(s) and acoustic instrument pickup(s) signals are recorded. Instrument is either placed on a stand on stage, or held by a musician at one or more locations in the performance space.

Microphone and pick-up signals are then used to estimate their transfer function, H(s), in the frequency domain. This process is detailed above in the background section.

Equation 4 is then used in real time to estimate the effect of the sound leaving the amplification system on the pickup system from the microphone signal(s).

Signals from step 720 may be negated (i.e., numeric values are multiplied by 1) and added to processed sensor signal from step 715 in summing junction 725 (i.e., effectively removing the noise or feedback sensed by the sensors mounted to the instrument). The summed signal in 725 may be post filtered in step 730 with a FIR or IIR digital filter. The post filter may be determined from the transfer function between the processed signal 725 and an ideal microphone signal in order to emulate the frequency response recorded by an external microphone.

The post-filtered signal from step 730 may be gain adjusted in step 735 to ensure the appropriate output amplitude. The gain adjusted signal from step 735 may then converted to the analog domain in DAC 650 and output in step 655.

The output signal 655 may be useful in live sound amplifications, especially in high-volume (loud) environments, where pickups or microphones may be susceptible to feedback and external noise. The method presented above may be useful in removing external noise and feedback from instrument pickups and internal microphones, allowing these systems to perform well in noisy environments.

In an alternative embodiment, anti-feedback microphone 615 may be used to measure the noise level outside the instrument, and decrease the amplification level of any microphones inside the instrument when outside noise levels are high, effectively decreasing the level of external noise picked up by internal microphones.

In an alternative embodiment, anti-feedback microphone 615 may be used to measure external sounds, and search for correlation between external sounds and pickups signals. If correlation above a predetermined threshold is identified, internal microphone amplification can be decreased, potentially reducing or eliminating acoustic feedback.

What is claimed is:

1. A system comprising:

an interface configured to receive information from one or more sensors associated with a first instrument;

a processing module configured to generate a processed signal by processing the received information according to a predetermined computational model, wherein parameters of the computational model are predetermined by operating on one or more stored sound recordings;

a parameter module configured to determine parameters for the computational model that, when applied to a first stored recording, minimize the difference between the first stored recording and a second stored recording, the first stored recording being received from one or more sensors associated with a second instrument, and the second stored recording being received from one or more microphones; and an output interface configured to output the processed signal.

2. The system of claim 1, wherein the information received from the one or more sensors is an analog signal that is converted to a digital signal prior to reaching the processing module.

3. The system of claim 1, wherein the processed signal is a digital signal, and is converted into an analog signal before being output.

4. The system of claim 1, wherein the first stored recording and the second stored recording are associated with the same musical instrument.

5. The system of claim 1, wherein the computational model comprises a learning model.

6. The system of claim 5, wherein the difference between the first stored recording and the second stored recording is the mean square error.

7. The system of claim 5, wherein the difference between the first stored recording and the second stored recording is computed in the frequency domain.

8. The system of claim 5, wherein the computational model comprises a plurality of sub-models, the parameters of each sub-model being determined by operating on pre-determined portions of one or more stored sound recordings, wherein the predetermined portions of the stored sound recordings are statistically similar.

9. The system of claim 1, wherein the one or more sensors associated with the second instrument comprise one or more musical instrument pickups.

10. The system of claim 1, wherein the first instrument and the second instrument comprise the same instrument.

11. A method comprising:

receiving, an electronic communication from one or more sensors;

performing numerical operations on the electronic communication;

wherein the numerical operations are determined by a predetermined computational model;

wherein the parameters of the computational model are predetermined by operating on stored sound recordings;

wherein predetermining the parameters of the computational model comprises:

assigning a stored recording made using a pickup attached to an instrument as the input to the computational model;

assigning a stored recording made using one or more external microphones of a musical instrument as the output of the computational model;

determining parameters for the computational model that, when applied to the input, minimize the variation between the model input and output; and outputting the operated on electronic communication.

12. The method of claim 11, wherein the electronic communication from the one or more sensors is an analog signal that is converted into a digital signal prior to performing numerical operations and the output electronic communication is a digital signal that is converted into an analog signal after being output.

13. The method of claim 11, wherein the stored recording made using a pickup and the stored recording made using one or more microphones are made with the same musical instrument.

14. The method of claim 11, wherein the variation between the model input and output is the mean square error.

15. The method of claim 11, wherein the computational model comprises a plurality of sub-models, the parameters of each sub-model being determined by operating on pre-determined portions of one or more stored sound recordings.

16. One or more non-transitory computer readable media having instructions operable to cause one or more processors to perform the operations comprising:

receiving, an electronic communication from one or more sensors;

generating a processed signal by performing numerical operations on the electronic communication;

wherein the numerical operations are determined by a computational model;

wherein the parameters of the computational model are determined by processing one or more stored sound recordings;

wherein determining the parameters of the computational model comprises:

assigning a first stored recording as the input to the computational model, the first stored recording being made using a pickup attached to an instrument;

assigning a second stored recording as the output of the computational model, the second stored recording being made using one or more external microphones of a musical instrument; and determining parameters for the computational model that, when applied to the first stored recording, minimize the difference between the first stored recording and the second stored recording; and outputting the processed signal.

17. The one or more non-transitory computer readable media of claim 16, wherein the electronic communication from the one or more sensors is an analog signal that is converted into a digital signal prior to performing numerical operations and the processed signal is a digital signal that is converted into an analog signal after being output.

18. The one or more non-transitory computer readable media of claim 16, wherein the first stored recording and the second stored recording are made with the same musical instrument.

19. The one or more non-transitory computer readable media of claim 16, wherein the difference between the first stored recording and the second stored recording is the mean square error.

20. The one or more non-transitory computer readable media of claim 16, wherein the difference between the first stored recording and the second stored recording is computed in the frequency domain.

* * * * *